US007134889B2

(12) United States Patent
Hughes et al.

(10) Patent No.: US 7,134,889 B2
(45) Date of Patent: Nov. 14, 2006

(54) SEPARABLE INSULATED CONNECTOR AND METHOD

(75) Inventors: David C. Hughes, Rubicon, WI (US); Paul M. Roscizewski, Eagle, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/029,779

(22) Filed: Jan. 4, 2005

(65) Prior Publication Data

US 2006/0148292 A1 Jul. 6, 2006

(51) Int. Cl.
*H01R 13/53* (2006.01)

(52) U.S. Cl. ..... 439/184

(58) Field of Classification Search ..... 439/184, 439/183, 185, 921, 205
See application file for complete search history.

(56) References Cited

U.S. PATENT DOCUMENTS

| | | | | |
|---|---|---|---|---|
| 3,670,287 | A | 6/1972 | Keto | |
| 3,946,183 | A * | 3/1976 | Milianowicz | 218/66 |
| 3,989,342 | A | 11/1976 | Fischer et al. | |
| 4,773,872 | A * | 9/1988 | Borgstrom et al. | 439/185 |
| 4,863,392 | A * | 9/1989 | Borgstrom et al. | 439/185 |
| 5,857,862 | A | 1/1999 | Muench et al. | |
| 6,168,447 | B1 * | 1/2001 | Stepniak et al. | 439/187 |
| 6,585,531 | B1 | 7/2003 | Stepniak et al. | |
| 2002/0164896 | A1 * | 11/2002 | Borgstrom et al. | 439/183 |
| 2003/0008542 | A1 * | 1/2003 | Schoepf et al. | 439/184 |

FOREIGN PATENT DOCUMENTS

| | | |
|---|---|---|
| DE | 27 10 868 A1 | 9/1978 |
| EP | 0 113 491 A1 | 7/1984 |
| EP | 0 817 228 A2 | 1/1998 |

OTHER PUBLICATIONS

Cooper Power Systems—Product Literature—Loadbreak Apparatus Connectors, 200 A 25 kV Class Loadbreak Bushing Insert (Service Information 500-26), (1 sheet).
Cooper Power Systems—Product Literature—Loadbreak Apparatus Connectors, 200 A 25 kV Class Loadbreak Bushing Insert (Service Information 500-12), (1 sheet).
Cooper Power Systems—Product Literature—OEM Equipment 200 A 35 kV Class Three Phase Integral Loadbreak Bushing (1 sheet).
International Search Report for PCT/US2006/000044, date of mailing Apr. 21, 2006, 3 pages.

* cited by examiner

*Primary Examiner*—Tulsidas C. Patel
*Assistant Examiner*—Phuongchi Nguyen
(74) *Attorney, Agent, or Firm*—Foley & Lardner LLP

(57) ABSTRACT

A separable insulated connector provides a current path for high-energy distribution between a power transmission or power distribution apparatus and an elbow connector. As gases and conductive particles exit the separable insulated connector during loadbreak switching, the gases and particles are re-directed away from a mating electrode probe and diverted along a path non-parallel to the electrode probe.

44 Claims, 3 Drawing Sheets

SEPARABLE INSULATED CONNECTOR AND METHOD

BACKGROUND

The present invention relates generally to the field of loadbreak switching. More particularly, this invention relates to enhancements in separable insulated connectors for reducing the probability of flashover during loadbreak switching.

RELATED ART

Separable insulated connectors provide the interconnection between energy sources and energy distribution systems. Typically, energy distribution is made possible through a large power distribution system, which results in power distribution to homes, businesses, and industrial settings throughout a particular region. In most cases, the distribution of power begins at a power generation facility, such as a power plant. As the power leaves the power plant, it enters a transmission substation to be converted up to extremely high voltages for long-distance transmission, typically in the range of 150 kV to 750 kV. Then, power is transmitted over high-voltage transmission lines and is later converted down to distribution voltages that will allow the power to be distributed over short distances more economically. The power is then reduced from the 7,200 volts typically delivered over a distribution bus to the 240 volts necessary for ordinary residential or commercial electrical service.

Separable insulated connectors typically consist of a male connector and a female connector. The mating of the male and female connectors are necessary to close the electrical circuit for distribution of power to customers. The female connector is typically a shielding cap or an elbow connector that mates with a male connector. The male connector is generally a loadbreak bushing that typically has a first end adapted for receiving a female connector (e.g., an elbow connector or shielding cap) and a second end adapted for connecting to a conductive stud. The first end of the male connector is an elongated cylindrical member with a flange on the rim of the member. The flange typically provides an interference fit between the bushing and the mating elbow connector. The flange secures the bushing to a groove in the inner wall of the mating elbow connector. The interference fit and the flange-groove mechanism are typical mating methods for a male and female connector.

Positioned within the male and female connectors are female and male contacts, respectively. The male contact is typically an electrode probe. The female contact is typically a contact tube that mates with the electrode probe from the female connector. When the male and female contacts mate, the electrical circuit is closed.

The process of separating these energized, electrical connectors is referred to as loadbreak switching. Since one or both connectors are energized during loadbreak, there exists a possibility of a flashover occurring. A flashover occurs when the electrical arc generated by an energized connector extends to a nearby ground point, which is undesirable. Particularly, for example, when a line-crew operator separates the male and female connectors in a loadbreak operation too slowly, the operator can drag the electrical arc out of the bushing. When the arc is dragged out of the male connector, the arc may flash over and seek a nearby ground point. Such an occurrence is undesirable and should be avoided.

During a switching operation, flashover may be caused at least in part by air pressure and conductive particles that build up within the electrical connectors. In order to equalize the pressure and gas within the connectors, a venting path is created to release the air pressure and gases during loadbreak switching. Typically, the venting path consists of a gap between an internal insulative layer within the bushing and the female contact. As the electrical connectors are separated and, as a result, the gases are released, the gases eject small fragments of conductive material (i.e., mainly copper and carbon) from within the bushing back toward the electrode probe. Since the fragments of copper and carbon are conductive, they can easily form a conductive path, resulting in a flashover induced by the gas dissipation.

Accordingly, it should be advantageous to develop a loadbreak connector that exhibits a reduced probability of flashover. It would be desirable to provide a separable insulated connector or the like of a type disclosed in the present application that includes any one or more of these or other advantageous features. It should be appreciated, however, that the teachings herein may also be applied to achieve devices and methods that do not necessarily achieve any of the foregoing advantages but rather achieve different advantages.

SUMMARY

One embodiment pertains to redirecting the gases and conductive particles through a venting path away from the mating male contact. A separable insulated connector, in accordance with one embodiment of the present invention, comprises a connector body with a venting path formed therein for venting gases and particles during a loadbreak operation. The terminal portion of the venting path diverts gases and particles away from the axis of motion of the male contact.

Still other advantages of the present invention will become readily apparent to those skilled in this art from review of the enclosed description, wherein the preferred embodiment of the invention is disclosed, simply by way of the best mode contemplated, of carrying out the invention. As it shall be understood, the invention is capable of other and different embodiments, and its several details are capable of modifications in various respects, all without departing from the invention. Accordingly, the figures and description shall be regarded as illustrative in nature, and not as restrictive.

DETAILED DESCRIPTION OF THE EXEMPLARY EMBODIMENTS

Figure 1:
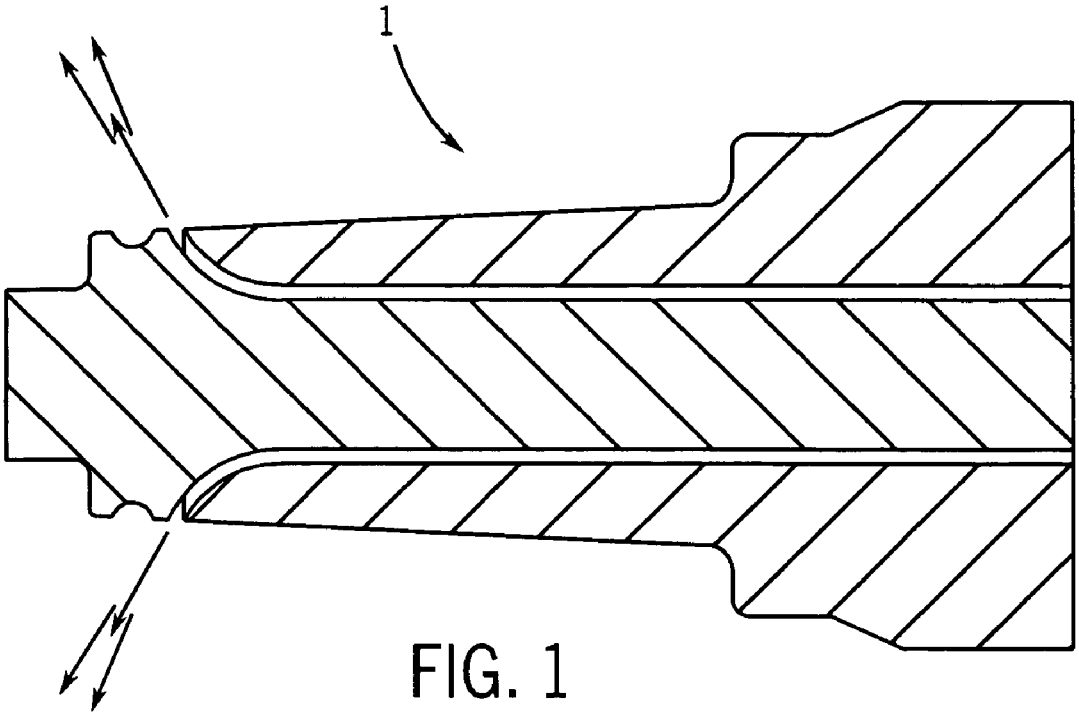
FIG. 1 is a layout of a venting path within a bushing that diverts the flow of gases and particles at angle between ten degrees (10°) and ninety degrees (90°), relative to the initial direction of the gas flow.

Referring to FIG. 1, a general layout of a venting path within bushing 1 is illustrated. The venting path diverts the flow of gases and particles at angle between ten degrees (10°) and ninety degrees (90°), relative to the initial direction of the gas flow. As gases and particles are generated during loadbreak switching, the matter travels through a venting path formed in the body of the bushing 1. The matter flows through the venting path in the general direction as the axis of motion of a mating connector. Upon reaching the terminal portion of the venting path, the venting path curves at an angle that allows the matter to exit bushing 1 and be redirected away in a non-parallel direction, which may be between ten degrees (10°) and ninety degrees (90°), relative to the initial direction of the gas flow. The venting path illustrated in FIG. 1 also may redirect the matter away from other energized apparatuses or ground planes. The venting path shown in FIGS. 1, 2, and 3 may be formed as a path, channel, gap, aperture, or other opening within the body of the bushing 1, or in other components within the connector body, to divert gases and particles.

Figure 2:
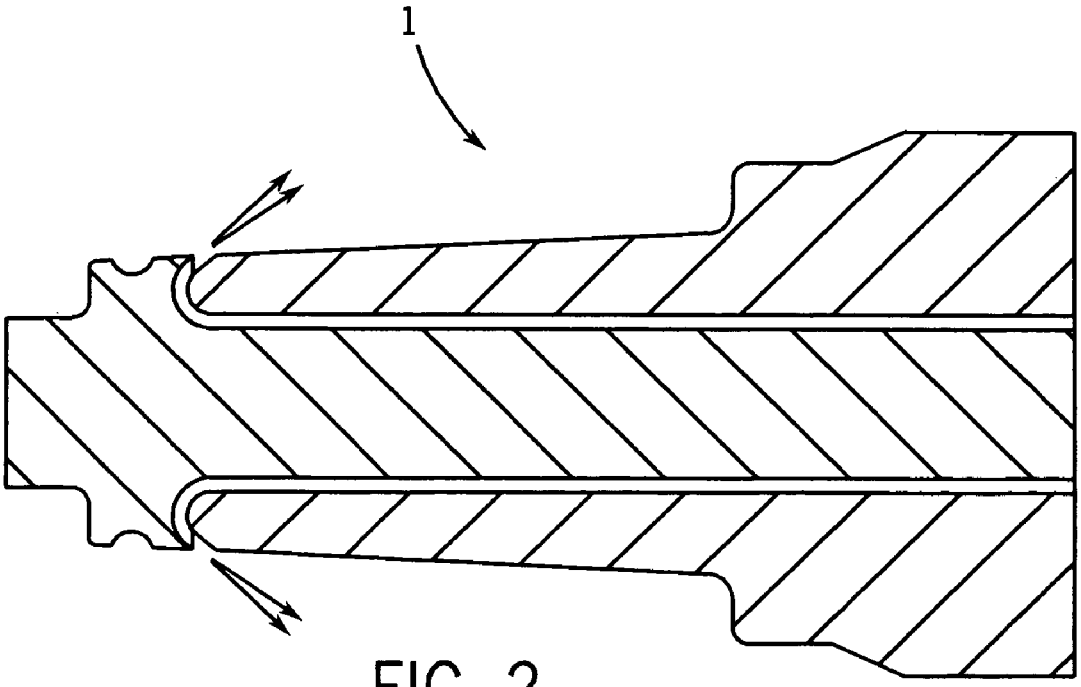
FIG. 2 is a layout of a venting path within a bushing that diverts the flow of gases and particles at angle between ninety degrees (90°) and one-hundred and eighty degrees (180°), relative to the initial direction of the gas flow.

FIG. 2 illustrates an alternative exemplary embodiment of a layout of a venting path within a bushing. The venting path diverts the flow of gases and particles at an angle between ninety degrees (90°) and one-hundred and eighty degrees (180°), relative to the initial direction of the gas flow. In some cases, it is desirable to expel the matter back away from the female connector and a mating male contact. In the venting path shown in FIG. 2, as gases and particles are generated during loadbreak switching, gases and particles travel through the path formed in the body of the bushing 1. Near the terminal portion of the venting path, the path curves at an angle between ninety degrees (90°) and one-hundred and eighty degrees (180°) that causes matter to exit bushing 1 and be redirected away from the mating connector.

Figure 3:
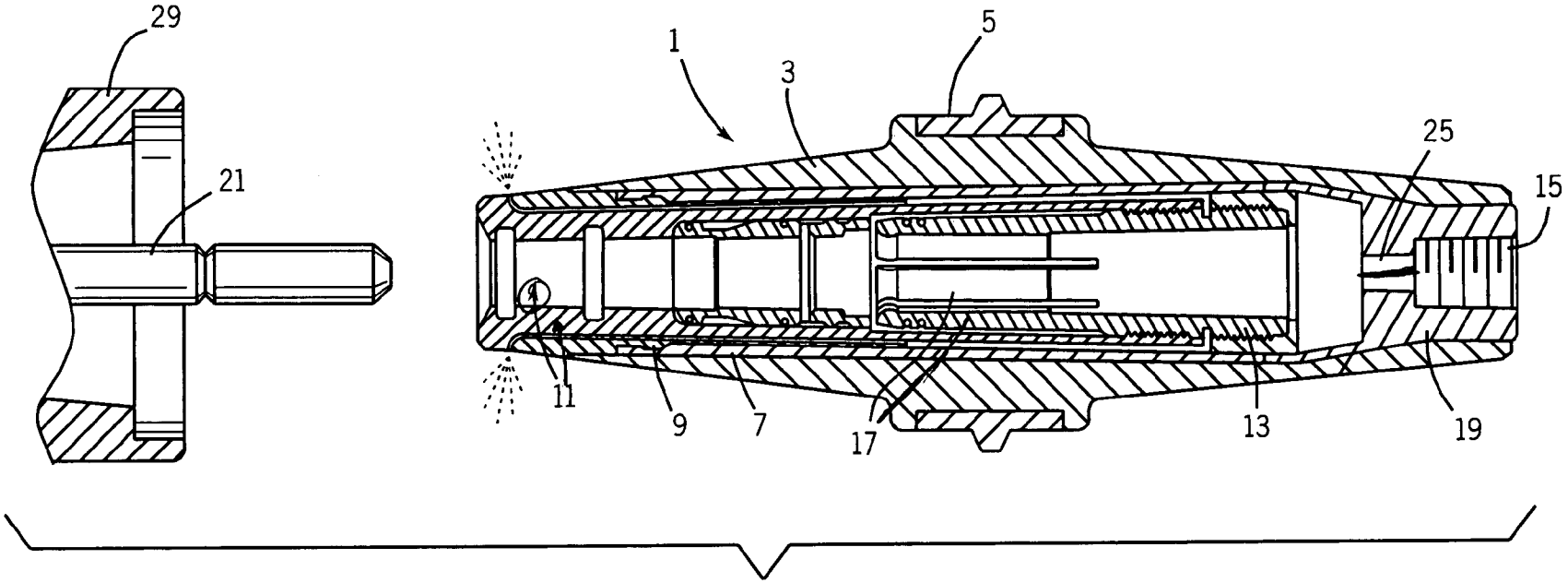
FIG. 3 is a cross-sectional view of a bushing with a contoured venting path to divert the flow of gases and particles away from the mating electrode probe.

Referring now to FIG. 3, a cross-sectional view of a bushing 1 with a contoured venting path to divert the flow of gases and particles away from the mating electrode probe 21 is illustrated. Loadbreak bushing 1 is contoured with a venting path that redirects the flow of gases and conductive particles away from the mating electrode probe 21. The degree of the venting path redirection may be within the range of between ten degrees (10°) and one-hundred and eighty degrees (180°), relative to the axis of motion of electrode probe 21. In FIG. 3, bushing 1 is housed in insulated housing 3 and has an axial bore therethrough providing a hollow center. Insulated housing 3 may be composed of a rubber compound; however, the housing is capable of being formed of other compositions. Insulated housing 3 has a first and second end, wherein the first end is an elongated cylindrical member for mating with elbow connector 29 and a second end adapted for connecting to a conductive stud.

The middle section of insulated housing 3, typically referred to as semi-conductive shield 5, is positioned between the first end and second end and is cylindrically larger than the first and second end. The middle section preferably comprises a semi-conductive material that provides a deadfront safety shield. Positioned within the bore of insulated housing 3 is an internal conductive layer 7 layered close to the inner wall of insulated housing 3. Internal conductive layer 7 preferably extends from near both ends of insulated housing 3 to facilitate optimal electrical shielding. Positioned within internal conductive layer 7 is internal insulative layer 9, which provides insulative protection for conductive layer 7 from a ground plane or electrode probe 21. Contact tube 11 is preferably a cylindrical member, which is capable of passing an electrode probe 21 from elbow connector 29. Contact tube 11 is slidably movable from a first position to a second position. In the first position, contact tube 11 is retracted into insulated housing 3, and in the second position, contact tube 11 extends substantially beyond the rim of the insulated housing 3 for receiving an electrode probe 21 during a fault closure. Contact tube 11 preferably comprises an arc-ablative component, which produces an arc extinguishing gas during loadbreak switching for enhanced switching performance.

The movement of contact tube 11 from the first to the second position is assisted by piston contact 13, which is affixed to contact tube 11. Piston contact 13 typically comprises copper or a copper alloy and has a knurled base with vents, providing an outlet for gases and conductive particles to escape which may be generated during loadbreak switching. Piston contact 13 also provides a reliable, multipoint current interchange to contact holder 19. Contact holder 19 is typically a copper component, positioned adjacent to conductive layer 7 and piston contact 13, for transferring current from piston contact 13 to a conductive stud, although contact holder 19 and conductive layer 7 may be integrally formed as a single unit. Contact tube 11 will typically be in its retracted position during continuous operation of bushing 1. During a fault closure, piston contact 13 slidably moves contact tube 11 to an extended position where it can mate with the electrode probe 21, thus reducing the likelihood of a flashover.

Positioned within contact tube 11 are a plurality of finger contacts 17. Finger contacts 17 are threaded into the base of piston contact 13, for providing a current path between electrode probe 21 and contact holder 19. As elbow connector 29 is mated with a bushing 1, electrode probe 21 passes through contact tube 11, in order to connect with finger contacts 17 for continuous current flow. Finger contacts 17 provide multi-point current transfer to a conductive stud. Additionally, bushing 1 has threaded base 15 for connection to a conductive stud. Threaded base 15 is positioned near the extremity of the second end of insulated housing 3, adjacent to hex broach 25. Hex broach 25 is preferably a six-sided aperture, which assists in the installation of a bushing 1 onto a conductive stud with a torque tool. Hex broach 25 is advantageous because it allows the bushing 1 to be tightened to a desired torque.

Figure 4:
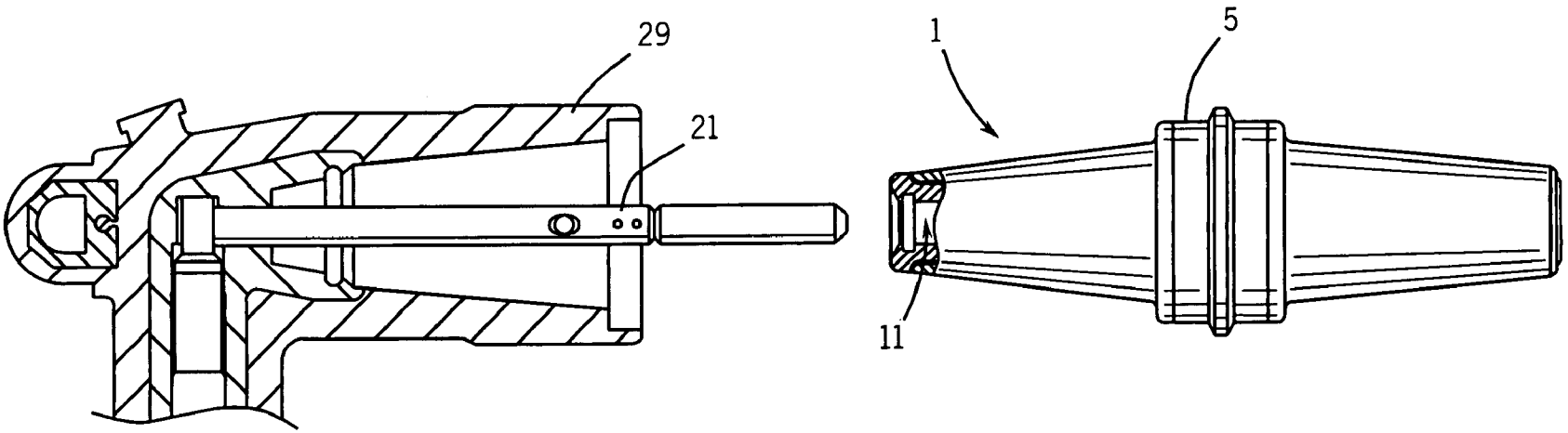
FIG. 4 is a general layout of an elbow connector and a bushing with a contoured venting path to divert the flow of gases and particles from the electrode probe of the elbow connector.

A venting path is created, such that the gases and conductive particles exit the hollow area of contact tube 11 and travel between the outer surface of contact tube 11 and internal insulative layer 9 to escape from the first end of insulated housing 3. As shown in FIGS. 3 and 4, however, the gases and conductive particles exit the venting path and are redirected away from electrode probe 21, which enhances switching performance and reduces the likelihood of a re-strike. FIG. 4 further illustrates a layout of the mating connection between bushing 1 and elbow connector 29, wherein bushing 1 has a contoured venting path to re-direct the flow of gases and particles from electrode probe 21 of elbow connector 29. As shown, the re-directional venting path is accomplished by adapting the contour of insulative layer 9 and contact tube 11, such that curvature is formed to divert the exiting gases and conductive particles along a path non-parallel to the axis of motion of mating electrode probe 21. The adapted curvature is within the range of between ten degrees (10°) and one-hundred and eighty degrees (180°), relative to the axis of motion of electrode probe 21. FIG. 3 illustrates a venting path curving at an angle within the range of ten degrees (10°) and ninety degrees (90°), in order to allow gases and particles to exit bushing 1 away from any energized apparatus or ground plane.

Throughout the specification, numerous advantages of exemplary embodiments have been identified. It will be understood of course that it is possible to employ the teachings herein so as to without necessarily achieving the same advantages. Additionally, although many features have been described in the context of a power distribution system comprising multiple cables and connectors linked together, it will be appreciated that such features could also be implemented in the context of other hardware configurations. Further, although certain methods are described as a series of steps which are performed sequentially, the steps generally need not be performed in any particular order. Additionally, some steps shown may be performed repetitively with particular ones of the steps being performed more frequently than others, when applicable. Alternatively, it may be desirable in some situations to perform steps in a different order than described.

Many other changes and modifications may be made to the present invention departing from the spirit thereof.

What is claimed is:

1. A loadbreak bushing for a power distribution or transmission system for receiving a male contact of a mating separable insulated connector, comprising:

a body having a venting path formed therein for venting particles and gases generated internally to the body during a loadbreak operation, and wherein the venting path is configured to vent the particles and gases externally from the body of the loadbreak bushing through a terminal portion which is divergent from the axis of motion of the male contact.

2. A loadbreak bushing according to claim 1, wherein the body comprises a conductive member adjacent to an inner wall of the body for electrical shielding.

3. A loadbreak bushing according to claim 1, wherein a rim of the body flares radially away from the center of the body.

4. A loadbreak bushing according to claim 1, wherein a plurality of multipoint contact members are seated within an axial bore of the body.

5. A loadbreak bushing according to claim 4, wherein a slidably movable cylindrical member is coupled to the plurality of multipoint contact members.

6. A loadbreak bushing according to claim 1, wherein the body is contoured to divert the path near its terminal portion at an angle ranging between ten degrees (10°) and one-hundred and eighty degrees (180°) relative to the axis of motion of the male contact.

7. A loadbreak bushing according to claim 6, wherein the path is diverted near its terminal portion at an angle ranging between thirty degrees (30°) and seventy degrees (70°) relative to the axis of motion of the male contact.

8. A loadbreak bushing according to claim 6, wherein the path is diverted near its terminal portion at an angle ranging between forty-five degrees (45°) and fifty-five degrees (55°) relative to the axis of motion of the male contact.

9. A loadbreak bushing according to claim 6, wherein the path is diverted near its terminal portion at an angle ranging between ninety (90°) and one-hundred and twenty degrees (120°) relative to the axis of motion of the male contact.

10. A method comprising expelling gases and particles from a loadbreak bushing having a venting path the gases and particles being generated internally to the loadbreak bushing during a loadbreak switching operation, wherein, during the switching operation, the loadbreak bushing is disengaged from a mating connector by movement along an axis of motion, and wherein the gases and particles are expelled from the loadbreak bushing along the venting path, wherein the venting path is configured to vent the gases and particles externally from the loadbreak bushing through a terminal portion which is divergent from the axis of motion.

11. A method according to claim 10, wherein the venting path is comprised of a curved channel within the bushing.

12. A method according to claim 10, wherein the gases and particles are captured by a means for retaining the expelled matter.

13. A method according to claim 10, wherein the gases and particles are expelled from the bushing at an angle ranging between ten degrees (10°) and one-hundred and eighty degrees (180°) relative to the axis of motion of the mating connector.

14. A method according to claim 13, wherein the gases and particles are expelled from the bushing at an angle ranging between thirty degrees (30°) and seventy degrees (70°) relative to the axis of motion of the mating connector.

15. A method according to claim 13, wherein the gases and particles are expelled from the bushing at an angle ranging between forty-five degrees (45°) and fifty-five degrees (55°) relative to the axis of motion of the mating connector.

16. A method according to claim 13, wherein the gases and particles are expelled from the bushing at an angle ranging between ninety (90°) and one-hundred and twenty degrees (120°) relative to the axis of motion of the mating connector.

17. A separable insulated connector for connecting a bushing well of a power transmission or power distribution apparatus and an elbow connector, comprising:

means for conducting current;

means for insulating, wherein means for insulating is layered against the internal wall of means for conducting current; and means for receiving an electrode probe, wherein means for venting the flow of matter is created between means for insulating and means for receiving an electrode probe, such that means for receiving and means for insulating are contoured to radially divert matter non-parallel to means for receiving an electrode probe.

18. A separable insulated connector according to claim 17, wherein the means for conducting current comprises ahuninum or copper.

19. A separable insulated connector according to claim 17, wherein the means for insulating comprises a plastic compound.

20. A separable insulated connector according to claim 17, further comprising means for engaging an electrode probe affixed to the means for receiving an electrode probe.

21. A separable insulated connector according to claim 20, further comprising means for slidably moving the means for receiving attached to the means for engaging an electrode probe.

22. A separable insulated connector according to claim 17, wherein means for venting the flow of matter diverts the matter at an angle ranging between ten degrees (10°) and one-hundred and eighty degrees (180°), relative to the axis of motion of means for receiving an electrode probe.

23. A separable insulated connector according to claim 22, wherein means for venting the flow of matter diverts the matter at an angle ranging between thirty degrees (30°) and seventy degrees (70°), relative to the axis of motion of means for receiving an electrode probe.

24. A separable insulated connector according to claim 22, wherein means for venting the flow of matter diverts the matter at an angle ranging between forty-five degrees (45°) and fifty-five degrees (55°), relative to the axis of motion of means for receiving an electrode probe.

25. A separable insulated connector according to claim 22, wherein means for venting the flow of matter diverts the matter at an angle ranging between ninety (90°) and one-hundred and twenty degrees (120°) relative to the axis of motion of means for receiving an electrode probe.

26. A separable insulated connector, comprising:

an insulated housing;

an internal conductive layer layered near the interior wall of the insulated housing;

an internal insulative layer layered against the interior wall of the internal conductive layer, having a first and second end; and a molded contact tube assembly, inserted in the insulated housing, having a first and second end, wherein the first end is positioned near a rim of the insulated housing and the second end is positioned approximately near a middle of the insulated housing, wherein the molded contact tube is configured such that a venting path is created between the internal insulative layer and the molded contact tube, and wherein the first end of the contact tube and the first end of the insulative layer are contoured to divert the venting path non-parallel to the contact tube.

27. A separable insulated connector according to claim 26, wherein the insulated housing is generally cylindrical.

28. A separable insulated connector according to claim 26, wherein the rim of the molded contact tube flares radially away from the hollow center of the contact tube.

29. A separable insulated connector according to claim 26, wherein the internal insulative layer extends only partially the length of the internal conductive layer.

30. A separable insulated connector according to claim 26, wherein the internal insulative layer comprises a high-strength molded plastic.

31. A separable insulated connector according to claim 26, wherein the contact tube is slidably movable from a first position to a second position, wherein the first position the contact tube is retracted in the hollow area of the insulated housing and in the second position, the contact tube extends substantially beyond the rim of the insulated housing for receiving an electrode during a fault closure.

32. A separable insulated connector according to claim 26, wherein a threaded base is positioned near the piston contact for connecting to a conductive stud.

33. A separable insulated connector according to claim 26, wherein affixed to the second end of the molded contact tube are a plurality of finger contacts.

34. A separable insulated connector according to claim 33, wherein a piston contact is affixed to the plurality of finger contacts.

35. A separable insulated connector according to claim 26, wherein the venting path is contoured between the internal insulative layer and the molded contact tube to divert the venting path away from the contact tube at an angle ranging between ten degrees (10°) and one-hundred and eighty degrees (180°) relative to the radial axis of the contact tube.

36. A separable insulated connector according to claim 35, wherein the venting path is contoured at an angle ranging between thirty degrees (30°) and seventy degrees (70°) relative to the radial axis of the contact tube.

37. A separable insulated connector according to claim 27, wherein the venting path is contoured at an angle ranging between forty-five degrees (45°) and fifty-five degrees (55°) relative to the radial axis of the contact tube.

38. A separable insulated connector according to claim 35, wherein the venting path is contoured at an angle ranging between ninety (90°) and one-hundred and twenty degrees (120°) relative to the radial axis of the contact tube.

39. A system comprising:

a power transmission or power distribution apparatus;

a separable insulated connector; and a bushing, including a first end and second end, wherein the first end of the bushing is connected to a mating separable insulated connector and the second end is attached to a conductive stud on the power transmission or power distribution apparatus, wherein during a switching operation, gases and particles generated in an internal bore of the bushing travel along a path within the bushing and are expelled from the bushing, wherein the path is configured to vent the gases and particles externally from the bushing through a terminal portion which is divergent from the axis of motion of the mating separable insulated connector.

40. A system according to claim 39, wherein the gases and particles are expelled from the bushing at an angle ranging between ten degrees (10°) and one-hundred and eighty degrees (180°) relative to the axis of motion of the mating separable insulated connector.

41. A system according to claim 39, wherein the gases and particles are expelled from the bushing at an angle ranging between thirty degrees (30°) and seventy degrees (70°) relative to the axis of motion of the mating separable insulated connector.

42. A system according to claim 39, wherein the gases and particles are expelled from the bushing at an angle ranging between forty-five degrees (45°) and fifty-five degrees (55°) relative to the axis of motion of the mating separable insulated connector.

43. A system according to claim 39, wherein the gases and particles are expelled from the bushing at an angle ranging between ninety (90°) and one-hundred and twenty degrees (120°) relative to the axis of motion of the mating separable insulated connector.

44. A system according to claim 39, further comprising means for capturing the gases and particles expelled from the bushing.

* * * * *

UNITED STATES PATENT AND TRADEMARK OFFICE

CERTIFICATE OF CORRECTION

PATENT NO. : 7,134,889 B2
APPLICATION NO. : 11/029779
DATED : November 14, 2006
INVENTOR(S) : David C. Hughes and Paul M. Roscizewski It is certified that error appears in the above-identified patent and that said Letters Patent is hereby corrected as shown below:

Column 6:
lines 45 and 46, replace “ahuninum” with --aluminum--.

Column 8:
line 9, replace “claim 27” with --claim 35--.

Signed and Sealed this

Twenty-ninth Day of May, 2007

JON W. DUDAS
*Director of the United States Patent and Trademark Office*